United States Patent [19]

Andersen et al.

[11] 4,059,364

[45] Nov. 22, 1977

[54] PITOT COMPRESSOR WITH LIQUID SEPARATOR

[75] Inventors: Poul H. Andersen, Torrance; John W. Erickson, Huntington Beach, both of Calif.

[73] Assignee: Kobe, Inc., Huntington Beach, Calif.

[21] Appl. No.: 688,176

[22] Filed: May 20, 1976

[51] Int. Cl.[2] ..... B04B 5/02; F03B 11/08

[52] U.S. Cl. ..... 415/89; 415/168; 233/17; 233/21

[58] Field of Search ..... 415/89, 88, 168, 121 A; 233/21, 27, 17, 18

[56] References Cited

U.S. PATENT DOCUMENTS

| | | | |
|---|---|---|---|
| 3,795,457 | 3/1974 | Erickson et al. | 415/89 |
| 3,936,214 | 2/1976 | Zupanick | 415/89 |
| 3,994,618 | 11/1976 | Erickson | 233/27 X |

*Primary Examiner*—Carlton R. Croyle
*Assistant Examiner*—Donald S. Holland
*Attorney, Agent, or Firm*—Cristie, Parker & Hale

[57] ABSTRACT

A gas compressor of the pitot type is equipped with means for separating liquid, entrained in supply gas to be compressed, from the supply gas prior to introduction of the supply gas into a pumping chamber within the compressor. A rotary casing is mounted for rotation in a selected direction about an axis of the compressor. A gas supply passage, for delivering a gas to be compressed, has an outlet to the interior of the casing. A compressed gas discharge duct leads from the compressor coaxially with the casing. A pitot tube extends radially from the compressor axis in the casing and has, adjacent its outer end, an inlet which faces in a direction opposite to the direction of rotation of the rotary casing. The pitot tube has a diffuser passage connected to the inlet and extending toward the casing axis to an outlet port connected to the compressed gas discharge duct. Liquid separating means are cooperatively associated with the gas supply passage upstream of its outlet for centrifugally separating liquid from gas in the supply passage. The liquid separating means are mounted for rotation with the casing.

18 Claims, 12 Drawing Figures

Fig. 6
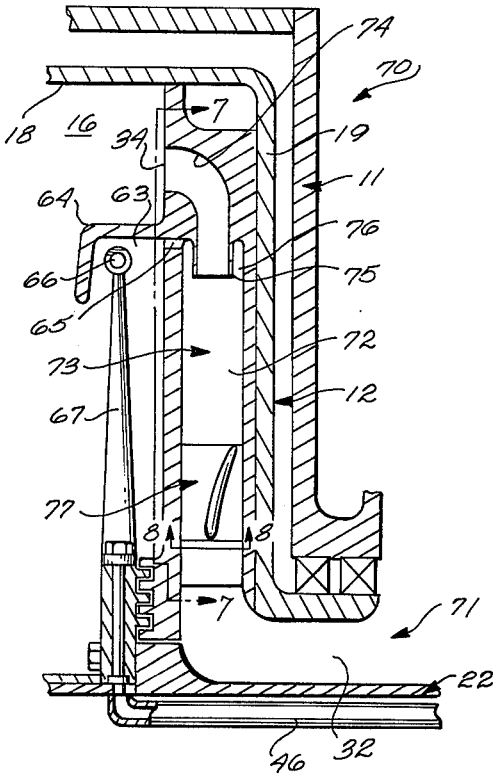
Fig. 7
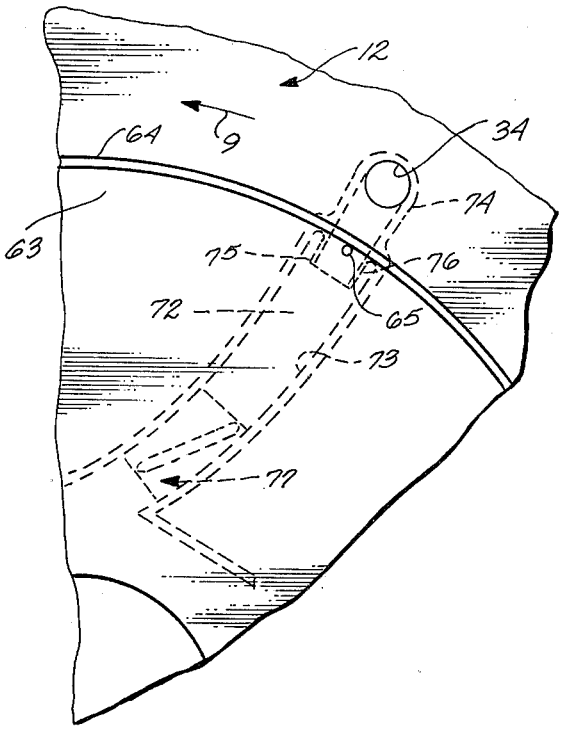
Fig. 9
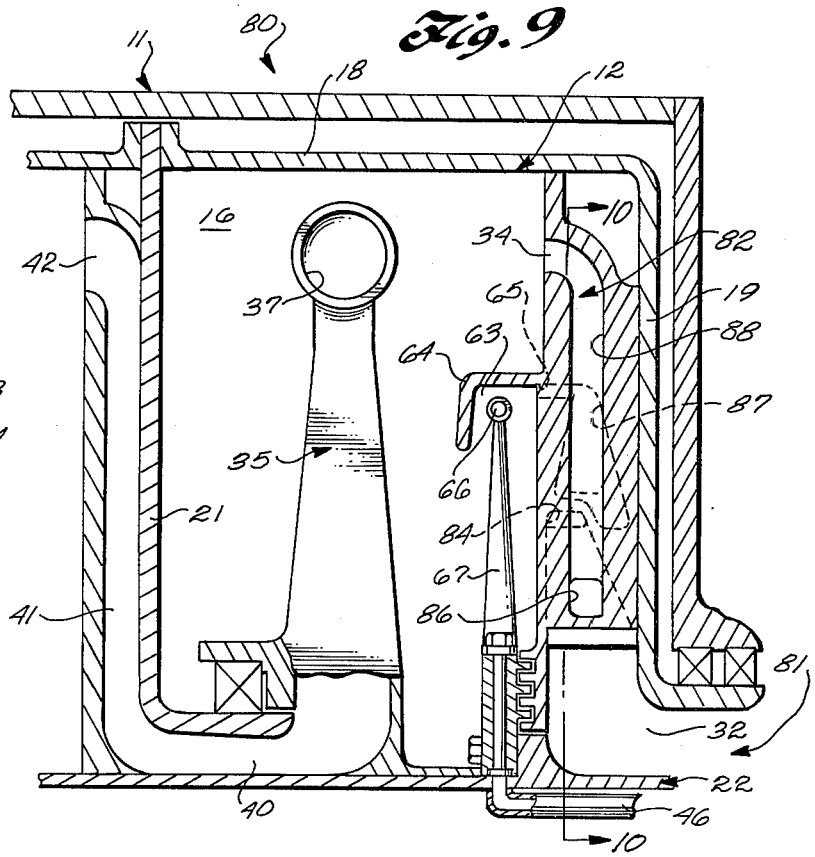
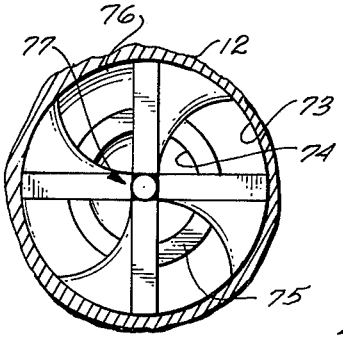
Fig. 8

Fig. 10
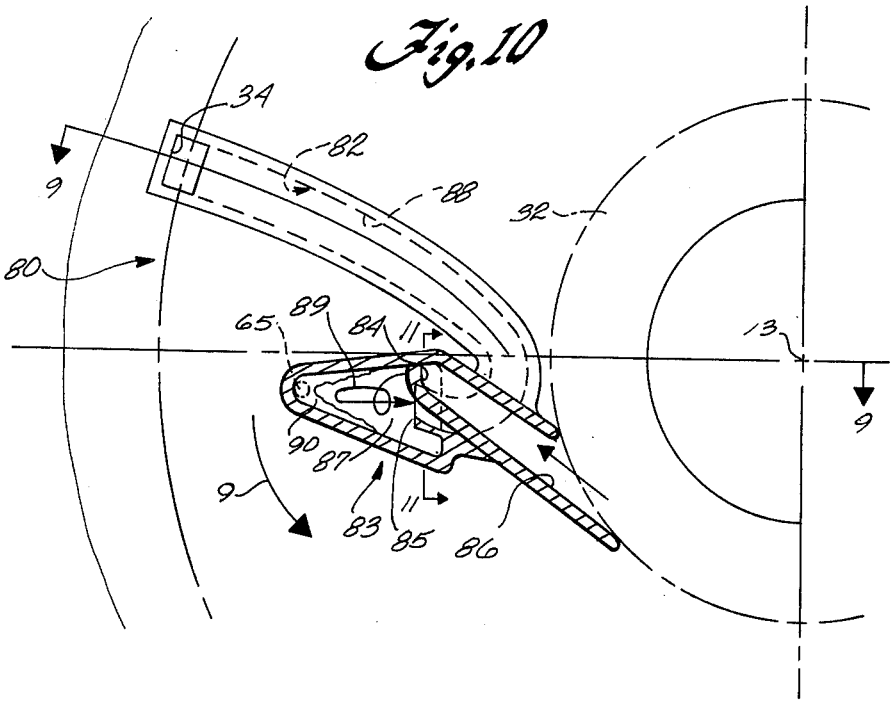
Fig. 11
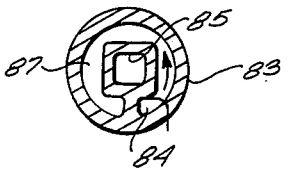
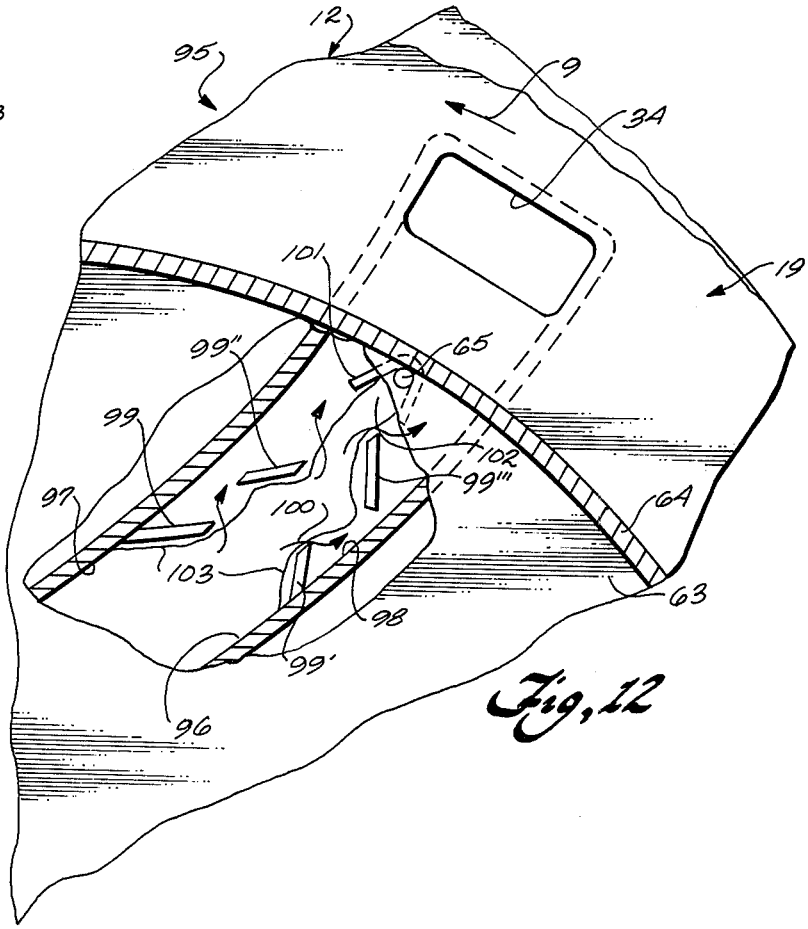
Fig. 12

PITOT COMPRESSOR WITH LIQUID SEPARATOR

FIELD OF THE INVENTION

This invention pertains to gas compressors. More particularly, it pertains to gas compressors of the pitot type equipped with means for separating liquid from gas introduced into the compressor prior to introduction of the supply gas into the pumping and compressing portions of the compressor.

REVIEW OF THE PRIOR ART

Liquid pumps of the pitot type are known. U.S. Pat. No. 3,795,459, for example, describes a pitot pump for pumping liquids, and U.S. Pat. No. 3,817,446 describes and illustrates a pitot pump for pumping liquids and equipped with a centrifugal separator for separating sediments and heavier liquids from the principal liquid.

In a pitot pump, a fluid to be pumped is introduced into a pumping chamber defined within a rotating hollow casing. The fluid preferably is introduced into the pumping chamber through passages, disposed generally radially of the casing axis, formed in a portion of the casing defining and end wall of the pumping chamber. The chamber end wall is therefore an impeller which imparts to fluid entering the chamber a velocity angularly about the chamber axis which is substantially the velocity of the outer periphery of the chamber. A pitot tube is fixedly mounted within the casing and has an opening spaced from the casing axis toward the outer periphery of the pumping chamber. The pilot tube inlet faces in the direction opposite to the direction of casing rotation. A diffuser passage extends within the pitot tube from the inlet radially toward the axis of the casing where it connects to a pumped fluid discharge duct disposed coaxially of the casing. Fluid from the pumping chamber enters the inlet of the pitot tube at high velocity but, in the course of flowimg along the diffuser passage toward the casing axis, has its velocity energy converted to static pressure energy. The pressure of the fluid in the discharge duct is substantially higher than the pressure of the fluid supplied to the inlet of the pump, depending upon the angular velocity of the casing and the location of the pitot tube inlet relative to the casing axis. Basically, a pitot pump, whether a pump per se for use in pumping liquids or a compressor for pumping and compressing gases, pressurizes the pumped fluid to the desired pressure by first imparting a high velocity to the fluid and then converting the velocity energy of the fluid to static pressure energy.

A pitot compressor must be operated at much higher revolutions per minute than a pitot pump of comparable size and pressurizing capacity in view of the lower density of a gas, as compared to a liquid, and in view of the compressibility of gases. Thus, while the liquid pump separator described in U.S. Pat. No. 3,816,446 in principle may be modified for use as a compressor with liquid separation capability, in reality such an adaptation is not practical. The practical difficulty is that, while this structure inherently provides for separation of entrained liquid from the supply gas so that the compressed gas discharged from the compressor is dry as desired, the liquid separator mechanism is located in the extreme outer periphery of the rotary casing. The casing of a pitot compressor, however, rotates at much higher speeds than a pitot pump for liquids. For this reason, the principal stresses encountered in the periphery of the casing of a pitot compressor are stresses due to centrifugal forces, rather than stresses due to fluid pressure in the casing. The centrifugal forces acting on the casing of a pitot compressor can be on the order of 50,000 g's. Therefore, structural integrity of the casing is a principal concern, and the pressure of a liquid separation mechanism in the periphery of the pitot compressor casing is inconsistent with this concern. Also, the gas supplied to the pitot compressor is often dry; peripheral liquid separation mechanisms in the compressor casing would pass gas most of the time, thus causing the compressor to leak.

A basic problem to which this invention is addressed is the presence of liquid from time to time in the gas supplied to a pitot compressor. The sudden introduction of liquid into the rapidly rotating casing of a pitot compressor produces centrifugal stresses much greater than those encountered when the compressor is handling dry gas. The result is that the casing may break apart under these loads. Merely making the compressor casing heavier greatly increases the inertia of the casing, thereby greatly compounding the time and energy required to start or to stop the compressor with a drive motor of given horsepower rating. The result of all of these considerations is that, in a pitot compressor, it is not desirable to incorporate a liquid separation mechanism in the outer periphery of the rotary casing as may safely be done in the pitot pump shown in U.S. Pat. No. 3,817,446.

In view of the foregoing, it would be expedient to provide gas-liquid separators in connection with but separate from pitot compresors. This practice, however, increases the overall size of the pitot compressor installation and requires the use of a separate drive motor for the separator. A need thus exists for a pitot compressor which includes a gas-liquid separator in the compressor structure, but in the portion of the compressor ahead of the pumping chamber so that gas supplied to the pumping chamber is free of entrained liquid, i.e., is dry.

SUMMARY OF THE INVENTION

This invention provides an improved pitot compressor which incorporates a mechanism for separating entrained liquid from gas supplied to the compressor prior to introduction of the supply gas to the interior of the rotary casing where the gas pumping and compressing functions are accomplished. The inclusion of the liquid-separating mechanism in the pitot compressor does not result in or require an increase in the overall size, i.e., diameter, of the compressor. The present compressor is effective, efficient and reliable.

Generally speaking, the present pitot compressor comprises a rotary casing mounted for rotation in a selected direction about an axis. A gas supply passage is provided for delivering a gas to be compressed through an outlet of the supply passage to the interior of the casing. A compressed gas discharge duct is disposed coaxial with the casing. A pitot tube extends radially of the axis within the casing and has, adjacent its outer end, an inlet which faces in a direction opposite to the direction of rotation of the casing. The pitot tube has a diffuser passage connected to the inlet, the diffuser passage extending toward the axis to an outlet port connected to the discharge duct. Liquid separating means are cooperatively associated with the gas supply passage upstream of the outlet thereof for centrifugally separating liquid from gas in the supply passage. In this manner, gas delivered to the interior of the casing is essentially free of iquid.

DESCRIPTION OF THE DRAWINGS

The above-mentioned and other features of this invention are more fully set forth in the following description of several illustrative embodiments of the invention, which description is presented with reference to the accompanying drawings, wherein:

FIG. 6 is a fragmentary elevation view of a portion of another pitot compressor;

FIG. 7 is a fragmentary elevation view taken along line 7—7 in FIG. 6;

FIG. 8 is an enlarged elevation view taken along line 8—8 in FIG. 6;

FIG. 9 is a fragmentary cross-sectional elevation view of a portion of yet another pitot compressor;

FIG. 10 is a simplified representation, partly in cross-section, taken substantially along line 10—10 in FIG. 9;

FIG. 11 is a cross-section view taken along line 11—11 in FIG. 10; and

FIG. 12 is a fragmentary elevation view, partly in section, of a portion of still another pitot compressor according to this invention.

DESCRIPTION OF THE ILLUSTRATED EMBODIMENTS

Figure 2:
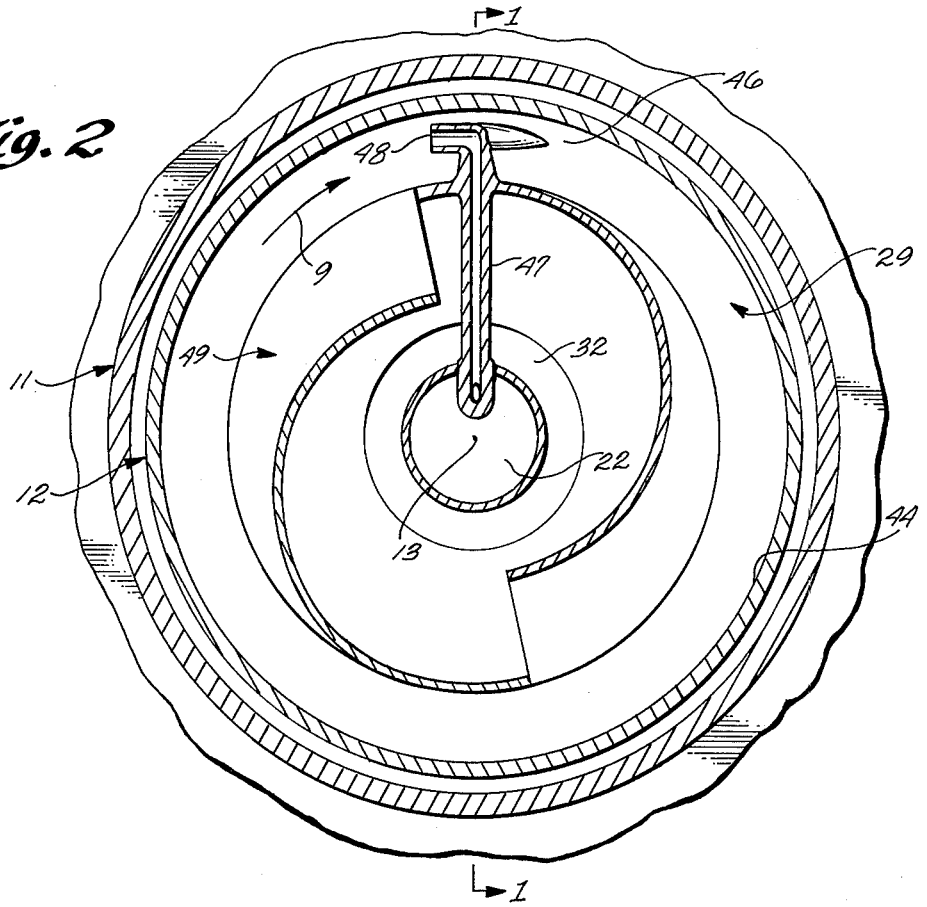
FIG. 2 is an enlarged cross-sectional elevation view taken along line 2—2 in FIG. 1.
Figure 3:
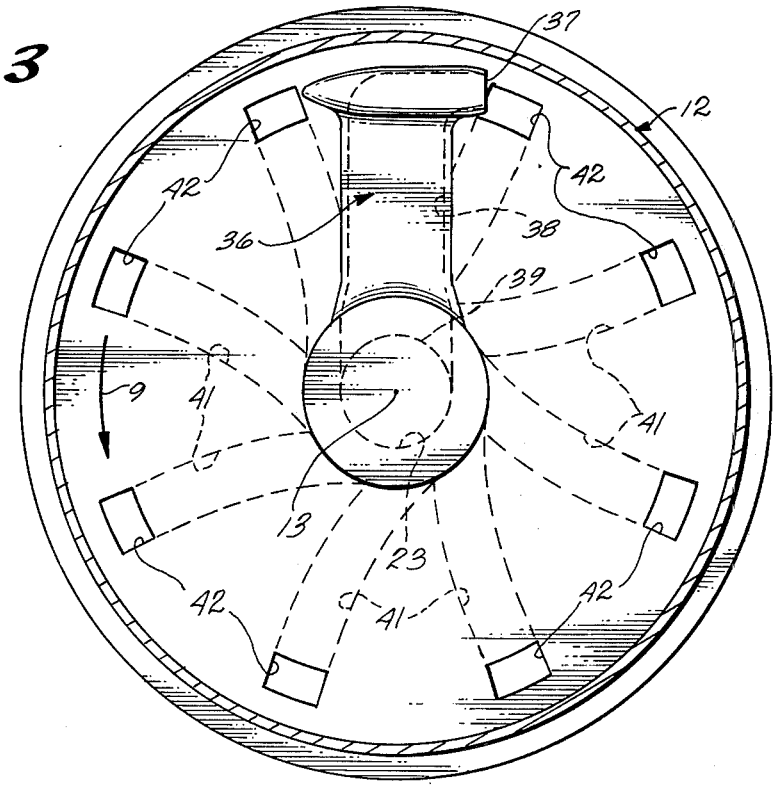
FIG. 3 is a cross-sectional elevation view taken along line 3—3 in FIG. 1.

A two-stage pitot compressor 10. shown in FIGS. 2 and 3, is the presently preferred embodiment of this invention. Compressor 10 includes an outer housing 11 and a hollow rotary casing 12. The casing is mounted within the housing for rotation in one direction about an axis 13 in response to operation of a drive motor (not shown) having a shaft 14 to which the casing is connected as by bolts 15. Axis 13 is also the axis of symmetry of the rotary casing 12. Arrow 9 in FIGS. 2 and 3 indicates the direction of rotation of the casing about its axis. The interior of the casing defines a low pressure pumping chamber 16 and a high pressure pumping chamber 17 bounded about their outer peripheries by an outer wall 18 of the casing and at their opposite ends by casing end walls 19 and 20, respectively. The high and low pressure pumping chambers are separated by an intermediate wall 21.

A stationary compressed gas discharge duct 22 is disposed coaxially of the casing and has an inlet end 23 in association with the high pressure pumping chamber and a discharge end 24 to the exterior of the compressor. A gas supply passage 25, sometimes also referred to as a gas intake passage, for delivering gas to be compressed to the interior of the casing is defined by the housing and by the casing concentrically about the discharge duct. The gas supply passage has an inlet 26 fitted with a suitable dust filter 27. Proceeding along the gas supply passage from its inlet 26 toward the low pressure pumping chamber 16, passage 25 has a first straight portion 28 disposed parallel to and circumferentially of the axis 13, a return bend spin-up portion 29 composed of an outflow portion 30 in which supply gas flows away from axis 13 and an inflow portion 31 in which supply gas flows generally toward axis 13, and a second portion 32 parallel to and circumferentially of the compressor axis in the vicinity of casing end wall 19 where the gas intake passage divideds into a plurality of branch passages 33 disposed radially in casing end wall 19. The several branch passages 33 each have a separate outlet opening 34 through the casing end wall into the low pressure pumping chamber adjacent the outer periphery of the pumping chamber. The several branch passages 33 function as impeller passages in casing end wall 19, the end wall itself forming an impeller by which energy is added to the supply gas stream so that supply gas entering the pumping chamber has substantially the same angular velocity about axis 13 as the casing itself. The outflow portion 30 of the intake passage also functions, to a lesser extent, as an impeller to impart energy to the supply gas.

Figure 1:
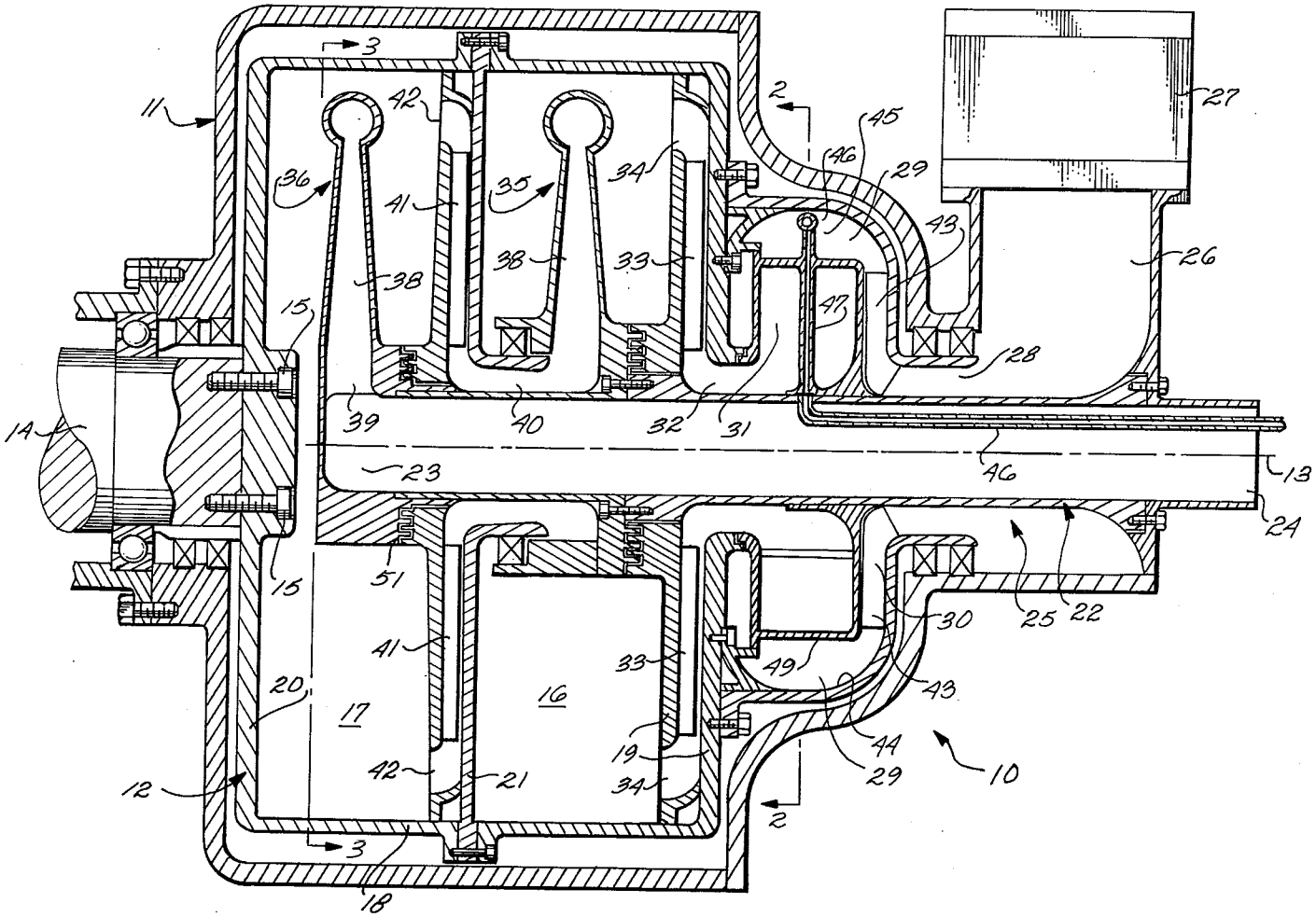
FIG. 1 is a cross-sectional elevation view of a two-stage pitot compressor which is the presently preferred embodiment of this invention.

A stationary pitot tube assembly 35 is disposed in the low pressure pumping chamber, and a similar pitot tube assembly 36 is disposed in the high pressure pumping chamber. Both pitot tube assemblies are carried by the gas discharge duct, as shown in FIG. 1, and extend radially into the adjacent pumping chamber toward the outer periphery of the pumping chamber. As shown best in FIG. 3 with respect to pitot tube assembly 36, each pitot tube assembly has an inlet 37 which faces in a direction opposite to the direction of rotation of the casing. Within the pitot tube assembly, the opening communicates with a diffuser passage 38 which extends radially toward axis 13. The diffuser passage in the high pressure pitot assembly communicates with the gas discharge duct via an outlet port 39. The diffuser passage of the low pressure pitot tube assembly communicates adjacent compressor axis 13 to the inlet end of a second stage gas intake passage 40 which extends first parallel to and circumferentially of the outlet duct towward the high pressure pumping chamber and then, via the second stage impeller, defined by intermediate wall 21 of the casing to the high pressure chamber. The second stage impeller includes a plurality of impeller passages 41, each similar to impeller passages 33, which open through a corresponding plurality of outlet openings 42 into the high pressure pumping chamber adjacent its outer periphery.

In operation of the compressor, casing 12 is rotated by motor shaft 14 at very high angular velocity, say, 20,000 rpm. This high velocity rotation of the casing causes air, for example, present in the impeller passages 33 and 41 to be centrifugally driven through outlet openings 34 and 42 respectively generally parallel to axis 13 into the low and high pressure pumping chambers respectively. The gas velocity through outlet openings 34 and 42 may be on the order of 500 feet per second. This in turn causes air to be drawn through filler 27 into the gas intake passage inlert 26 on a continuous basis. As noted above, the angular velocity of the air entering the pumping chamber is substantially the same as the angular velocity of the casing. In the pumping chambers, additional energy is imparted to the air by friction with the casing only to the extent necessary to overcome the drag effect of the corresponding pitot tube assembly. A portion of the air which is rotating with the casing in each pumping chamber enters the pitot tube assembly inlet 37 to flow radially toward the compressor axis. Since the pitot tube assembly in each pumping chamber is stationary, the velocity energy (dynamic pressure) present in the air entering the pitot tube inlet is converted in the diffuser passage 38 to static pressure energy as the air moves toward the compressor axis. The velocity of gas flow through the pitot inlet can be on the order of 1000 feet per second, i.e., approaching Mach 1.0. The air which enters second stage gas intake passage 40 from the low pressure pitot tube assembly is further compressed, by being accelerated in the high pressure pumping chamber, and then by having its velocity energy converted to static pressure energy upon entering the high pressure pitot tube assembly and flowing radially toward the compressor axis into the compressed gas discharge duct 22.

As shown in FIG. 1, the outer walls (the walls radially outward from axis 13) of gas intake passage 25 are defined principally by rotary casing 12; the inner walls of the passage are defined either by the outer surfaces of the stationary gas discharge duct 22, or by a stationary scroll assembly 49 mounted to the discharge duct and associated with the return bend portion 29 of the gas intake passage. The branch impeller passages 33 of gas intake passage 25 are defined entirely by the casing. A plurality of vanes 43 are carried by the rotating casing and extend across the outflow portion 30 of the supply passage return bend portion 29, as shown in FIG. 1. In particular, the extreme outer boundaries 44 of the gas intake passage in the return bend portion thereof are defined by the rotary casing. Passage surfaces 44, in conjunction with the configuration of the gas intake passage through the return bend portion thereof, comprise means 45 for separating liquid from gas flowing through the gas intake passage toward the pumping chambers of the compressor. Viewed in another way, the annular chamber defined in the outer part of return bend portion 29 is a liquid separation chamber in compressor 10.

Any liquid present in gas flowing through the gas supply passage return bend portion, due to the high angular velocity of the casing, is centrifugally separated from the gas to impinge upon the radially outward surfaces 44 of the gas supply passage, and to accumulate in the outermost extremities (relative to axis 13) of the gas intake return bend portion. The inwardly concave radial extremities of the return bend portion of the gas supply passage serve as a collecting receiver 46 for liquid centrifugally separated from supply gas flowing through this portion of the passage. Liquid collected in receiver 46 is withdrawn from the interior of the compressor via an extraction tube 47 which has an inlet 48 disposed closely adjacent to casing surface 43 in the liquid collector area 46. The extraction tube is stationary, and is so positioned in the gas supply passage that the inlet faces in a direction opposite to the direction of rotation of the casing, as shown best in FIG. 2. From its inlet 48, the extraction tube leads radially toward the compressor axis into the compressed gas discharge duct, and then parallel to the compressor axis within the discharge duct to whatever remote discharge point is desired.

Preferably, as shown in FIGS. 1 and 2, the liquid extraction duct is disposed in the gas intake passage in association with a scroll assembly 49 which collects gas from the outer extent of the return bend portion, and leads it back radially inwardly of the compressor toward the inlet to the several impeller branch passages 33 defined in casing end wall 19. The scroll assembly also serves to separate the outflow 30 and inflow 31 sections of the return bend portion from each other.

In view of the nature of the structure described above, it will be apparent that, in operation of compressor 10, the gas entering the low pressure pumping chamber 16 is essentially free of liquid. Accordingly, casing 12 may be rotated at very high velocities and not be subject to hazardous high stresses due to introduction of liquid into the pumping chamber in the outer periphery thereof. Also, the casings can be made as light as possible to enable rapid start up by a relatively small drive motor.

As shown in FIG. 3, impeller branch passages 33 and 41 of compressor 10 are sloped or inclined, in a direction opposite to the direction of casing rotation, relative to radii of the casing for optimum efficiency.

Liquid separating mechanism 45 is illustrated in FIGS. 1, 2 and 3 in the context of two-stage compressor 19 merely for the purposes of example and illustration. It will be appreciated that this liquid separation mechanism may be used in a single-stage compressor, or in a three or more stage compressor as desired. In a single-stage compressor, only a single pumping chamber is defined within the interior of the rotary casing, and the diffuser passage within the pitot tube assembly connects directly to the compressed gas discharge duct.

The remaining illustrated embodiments of this invention, shown in FIGS. 4–12, are similar in that, while not shown in all cases in FIGS. 4–12, each of compressors 55, 70, 80 and 95 includes a stationary housing 11, a rotary casing 12, a stationary compressed gas discharge duct 22 coaxial with the casing, and other structures and features in accord with the foregoing description of compressor 10. Accordingly, in the description of these further embodiments of the invention, structural features corresponding either exactly or substantially to structural features previously described are not again described, and the same reference numbers as have previously been used are used again to facilitate correlation between the structures and features of these other embodiments with the presently preferred embodiment already described in detail.

Figure 4:
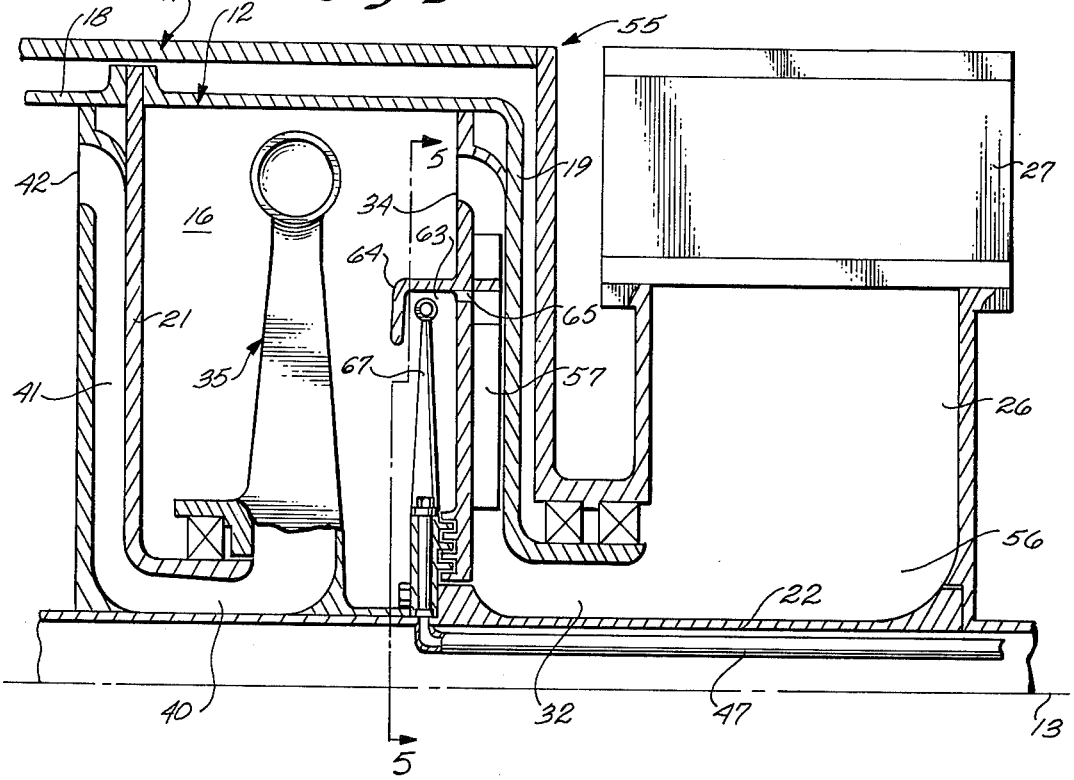
FIG. 4 is a fragmentary cross-sectional elevation view of the inlet and first stage portions of another multistage pitot compressor.
Figure 5:
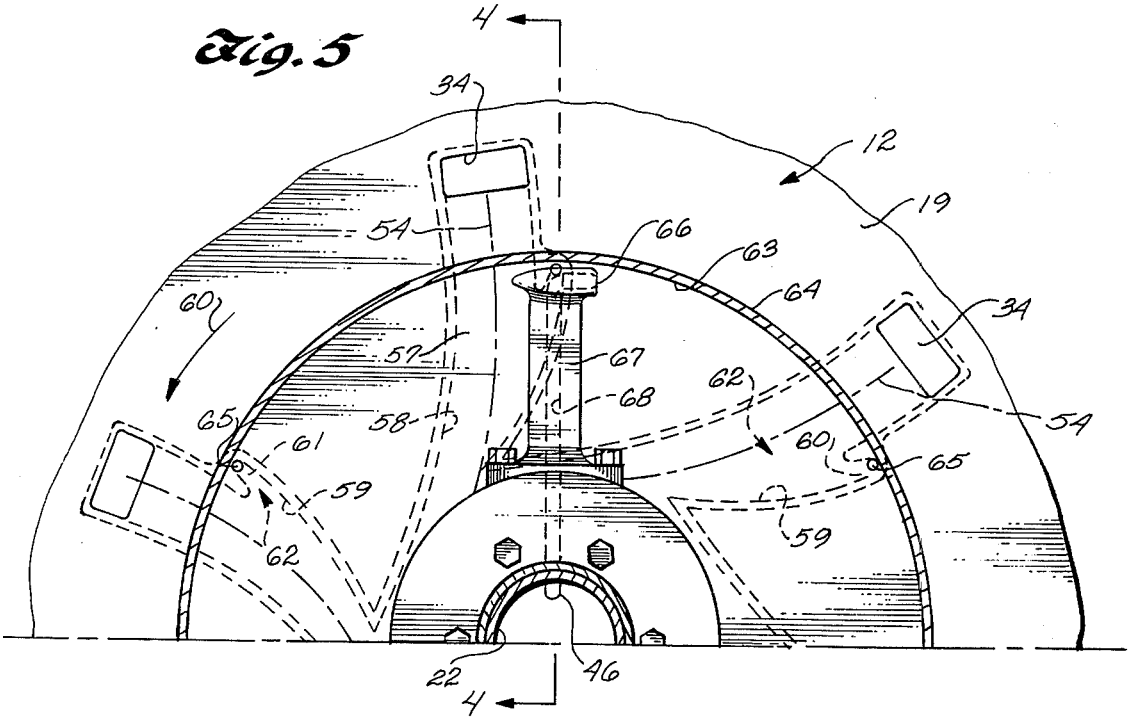
FIG. 5 is an elevation view taken along line 5—5 in FIG. 4.

Another two-stage pitot compressor 55 is shown in FIGS. 4 and 5. Compressor 55 has a gas intake passage 56 which has a radial inlet 26 from a filter 27 to a straight portion 32 parallel to and circumferentially of gas discharge duct 22 disposed within the casing and leading to a plurality of impeller branch passages 57 formed in casing end wall 19. Branch passages 57 are not aligned along radii from axis 13. Instead, in compressor 55, as shown in FIG. 5, branch passages 57 are so disposed in the casing end wall that, proceeding outwardly from the compressor axis 13, they progressively lag behind radial lines in the casing in such manner that the outlet openings 34 from the branch passages into pumping chamber 16 are displaced, in a lagging manner relative to the direction of rotation of the casing, behind the inlets from the supply passage portion 32 into the branch passages. Each branch passage 57 has a forward wall 58 and a rear wall 59 relative to the direction of casing rotation, as indicated by arrow 60 in FIG. 5. Each branch impeller passage 57 also has a centerline 54, as shown; the passage forward walls 58 are each parallel to the respective passage centerline, but the passage rear walls are not along their entire extent radially of axis 13 due to the nature of the liquid separation means used in compressor 55.

As to each impeller branch passage 57, the angle of the passage centerline, relative to a plane radially of axis 13 and through the center of the inlet end of the impeller passage, is an angle which is determined by the vector sum of the radial and tangential velocities of supply gas entering the impeller passages from portion 32, for example, of the gas intake passage. Thus, this angle is defined with respect to the design rpm's and the design flowrate of supply gas through the impeller passages; the slope of the impeller passage centerline at each point along its length to the outlet opening 34 to the pumping chamer is similarly defined. This curvature of the impeller passages results in maximum conversion of casing rotational energy to velocity energy in the gas flowing through the passage with minimum energy losses due to turbulence generation and the like in the impeller passage. The overall benefit is a reduction in the size of the motor required to rotate the casing at its design speed.

It is within the context of an impeller configuration as generally described above that the liquid separation mechanism of compressor 55 is provided in the impeller passages themselves. Each branch passage rear wall 59 is configured, out of parallel to the passage centerline 54, in a re-curved manner to define, at a location intermediate the radial extent of the branch passage, a recess 61 which faces generally toward the axis of the compressor. Each recess 61, in conjunction with the configuration of the branch passage in casing end wall 19, defines a liquid separating mechanism 62 in each branch passage. Thus, as the casing is rotated rapidly during operation of the compressor, any liquid present in gas flowing through the branch passages, because of its greater inertia compared to the inertia of the gas, tends to respond less rapidly than the gas to acceleration forces about the compressor axis in the direction of casing rotation. Accordingly, liquid entrained or contained in the gas flowing through the branch passages accumulates along the branch passage rear walls 59 and, due to centrigugal forces, is forced to flow along these walls into recesses 61. Receses 61 are aligned along a common circle about the axis 13, which circle has a radius less than the radius of the circle along with the branch passage outlet openings 34 are positioned.

A circular liquid collecting recess 63 is defined along the casing end wall immediately adjacent to impeller passage recesses 61. Thus, as shown in FIG. 4, a liquid collection recess 63 is defined within pumping chamber 16 on the radially inward side of projection 64 which extends circumferentially about axis 13 first parallel to axis 13 from casing end wall 19 into the pumping chamber, and then radially toward the casing axis, as shown in FIG. 4. The inwardly open collection recess 63 is communicated to each of the several passage recesses 61 by respective liquid flow openings 65 formed through the casing end wall. In this manner, liquid which accumulates in each passage recess 61 can flow through the corresponding opening 65 into the main collection recess 63. Liquid accumulated in the main collection recess is extracted from the interior of the compressor by an extraction duct 46 which has its inlet 66 (see FIG. 5) located in the main collection recess and facing in a direction opposite to the direction of casing rotation. The extraction duct inlet is defined in the outer end of a stationary, hollow radial vane 67 which is secured to the outer surface of the compressed gas discharge duct. A radial passage 68, defined by the interior of the vane, extends from inlet 66 to the interior of the extraction duct 47, as shown in FIGS. 4 and 5.

Any liquid which is present in the supply gas entering impeller passages 57 of compressor 55 is separated from the supply gas before the gas reaches the outlet openings 34 from the impeller passages into pumping chamber 16.

Another pitot compressor 70, shown in FIGS. 6, 7 and 8, has a gas supply and intake passage 71 which connects to a plurality of generally radial branch impeller passages 72, comprising the impeller formed in the casing end wall 19, via a straight throat portion 32 disposed parallel to and circumferentialy about compressed gas discharge duct 22. Impeller passages 72 preferably are of circular cross-section. Each impeller passage has a larger diameter inlet portion 73 and a smaller diameter outlet portion 74 terminating in the outlet opening 34 into pumping chamber 16 adjacent the outer periphery of the pumping chamber. The smaller diameter portion 74 of each impeller passage communicates to the larger diameter portion through a circumferential sleeve 75 which has an outer diameter less than the diameter of the passage larger diameter portion 73. In this manner, an annular recess 76 is defined circumferentially about each sleeve 75. Recesses 76 are positioned along a common circle about the compressor axis and serve as initial collecting recesses for liquid which flows radially outwardly along the walls of the impeller passage in the greater diameter portion 73 thereof after having been separated from supply gas flowing through the passage.

Separation of liquid from gas flowing through the larger diameter portion of each impeller passage 72 is obtained by imparting a spiral flow to the supply gas as it flows through the passage toward sleeve 75 from gas intake passage throat portion 32. The spiral flow of gas in the impeller passages is accomplished by locating in each passage, at a location therealong toward the compressor axis from sleeve 75, a vane assembly 77 which is configured to impart a spiral flow characteristic to gas flowing therepast. This spiral flow characteristic applies centrifugal forces to the gas-liquid mixture in the impeller passages, within the vane assemblies and between the vane assemblies and sleeve 75, which tends to throw the entrained liquid against the walls of the impeller passage upstream of initial collection recess 76. This spiral flow acts on the entrained liquid in conjunction with the centrifugal forces due to rotation of the casing itself.

As shown in FIGS. 6 and 7, an opening 65 is provided from each recess 76 into a principal collection recess 63 defined by a projection 64 carried by the casing end wall 19 within pumping chamber 16. Liquid accumulated in the collection recess 63 is extracted from the interior of the compressor by an extraction tube 46 and by an extraction passage 68 in a vane 67 in accord with the foregoing description presented pertinent to compressor 55.

Another multistage pitot compressor 80, shown in FIGS. 9–11, has a gas intake and supply passage 81 which connects via a straight throat portion 32 disposed parallel to and circumferentially about a compressed gas discharge duct 22 to a plurality of branch impeller passages 82 defined in casing end wall 19 and opening into pumping chamber 16 through respective outlet openings 34. Rotary casing 12 defines, in assocation with each impeller passage 82, a cyclone-type gas-liquid separator 83. The cyclone-type separators 83 rely upon centrifugal forces generated within them by virtue of their geometrical arrangements, and also upon the centrifugal forces produced by rotation of casing 12 about its axis. Since the cyclone-type separators 83 are provided in the rapidly rotating casing 12, the several separators are inverted, at least as to axis 13 but not as to the centrifugal force field, and have their liquid discharge openings 65 disposed radially outwardly from axis 13 relative to a gas-liquid entrance opening 84 and a gas exit opening 85 to and from each separator, respectively.

As shown best in FIG. 10, each impeller passage 82 in compressor 10 has a gas-liquid section 86 which extends between supply passage throat 32 to a separation chamber 87 in the separator via the gas-liquid inlet opening 84. The gas-liquid section of each impeller passage is oriented in a lagging manner relative to a radius through the casing and relative to the casing direction of rotation, as described above. The disposition of each impeller passage section 86 relative to the conical separation chamber 87 is such that the gas-liquid mixture entering the separation chamber flows tangentially along and around the walls of the separation chamber. Each branch passage 82 also includes a gas flow section 88 which begins at the gas exit opening 85 from the separation chamber, and which extends first generally toward compressor axis 13 and then away from the compressor axis to the impeller passage outlet opening 34 to the pumping chamber.

Also as shown in FIG. 10 by arrow 89, the flow of gas entering separation chamber 87 is spirally along and around the walls of the separation chamber first in a direction outwardly from compressor axis 13 and then back toward the compressor axis to the gas exit opening 85. In the course of undergoing this flow pattern within the separation chamber, liquid entrained in the supply gas entering the separation chamber is deposited along the chamber walls, as represented at 90 in FIG. 10. The radially outermost portion of separation chamber 87, i.e., the apex of the conical chamber, serve as a sump for the accumulation of liquid separated in the chamber from the gas-liquid mixture entering the chamber, the sump connecting by opening 65 through the chamber end wall into principal collection recess 63 defined by projection 64 within pumping chamber 16 (see FIG. 9). The inlet 66 to a liquid extraction passage, defined by vane 67 and connecting to gas extraction tube 46, is located within collection recess 63 for collecting and leading from the compressor liquid which is supplied to the collection recess from the several separators 83 via openings 65.

FIG. 12 is a fragmentary elevation view, partly in cross-section, of a portion of another compressor 95 according to this invention. FIG. 12 and FIG. 7 are similar in that FIG. 12 shows substantially the same portion of compressor 95 which is shown by FIG. 7 as to compressor 70. Since compressors 95 and 70 are similar except to the extent illustrated by the differences between FIGS. 12 and 7 respectively, only FIG. 12 is presented to illustrate the nature of compressor 95.

In compressor 95, the gas supply passage includes a plurality of branch impeller passages 96 defined in casing end wall 19, each impeller passage having an outlet opening 34 to the compressor pumping chamber. Each passage 96 has a forward wall 97 and rear wall 98 relative to the direction of rotation of the casing, as well as side walls extending between the forward and rear walls adjacent to and opposite from the pumping chamber. A plurality of baffle vanes 99–99‴ are positioned in the branch passage 97 to extend between the side walls thereof partially across the passage.

Proceeding along the impeller passage toward its outlet opening 34, the first baffle vane encountered extends at an angle to the elongate extent of the passage from forward wall 97 partially across the passage toward the rear wall 98. The next baffle 99′ encountered is spaced along the elongate extent of the passage from baffle 99, is angled relative to the elongate extent of the passage, and extends only partially across the passage toward the passage front wall. The next baffle 99″ encountered is more intimately associated with the passage front wall than the rear wall, but is not in contact therewith and is angled relative to the direction of gas flow along the passage in the same manner as baffles 99 and 99′. Baffle 99″ has its upstream end located closer to passage front wall 97 than the downstream end of baffle 99. The next baffle 99‴ encountered is more intimately acssociated with the passage rear wall and is angled relative to the elongate extent of the passage, but is spaced from the passage rear wall 96 so as to have its upstream end located closer to the passage rear wall than the downstream end of baffle 99′. The group of baffles 99 includes a terminal baffle 101 which is arranged to define a recess 102 which opens down the central portion of the impeller passage generally toward the inlet to the passage from the throat 32 of the gas intake passage.

As a mixture of gas and liquid flows along the impeller passage toward outlet opening 39, it impinges upon the upstream faces of the several baffles 99 to 99‴. Such impingement causes the liquid entrained in the gas to deposit itself (as represented at 103) on the downstream faces of the baffles and to flow along the baffle surfaces toward the center of the passage, the remaining gas flowing around the baffles and along the passage front, rear and side walls, as represented by arrows 100. Since terminal baffle 101 is defined across the central portion of the impeller passage, it receives in recess 102 the liquid flowing along the central portion of the passage from the downstream ends of the baffles which precede it; this is also represented in FIG. 12. Each recess 102 communicates by an opening 65 into a collection recess 63 defined by a projection 64 in the pumping chamber, the projection being carried by the casing end wall 19 in the manner described above. In view of the preceding description, it will be apparent that a liquid extraction passage is defined, as by a vane 67 and an extraction duct 46, to have its inlet opening disposed within collection recess 63 for gathering and leading from the compressor liquid which is supplied by openings 65 from the several recesses 102 into the principal collection recess within the pumping chamber.

In view of the ciruitous path which gas must follow past baffles 99–99‴ and 101 in moving along each impeller passage 97, it is apparent that the gas which enters the pumping chamber of compressor 95 through outlet openings 34 has had all liquid entrained in it removed from it as the gas enters the pumping chamber. The several baffles disposed in the manner described above across the interior of each passage 97 comprise the centrifugally functioning liquid separation mechanism in compressor 95.

Workers skilled in the art to which this invention pertains will appreciate that modifications, alterations or variations in the structures or procedures described above may be made or practiced without departing from the scope of this invention. In view of the alterations or the like which may be made to the present invention as illustrated by the embodiments thereof described above, the following claims are not to be considered as limiting the precise scope of this invention.

What is claimed is:

1. A pitot compressor comprising a. a rotary casing mounted for rotation in a selected direction about an axis, b. a gas supply passage for delivering a gas to be compressed through an outlet of the gas supply passage to the interior of the casing, c. a compressed gas discharge duct coaxial with the casing, d. a pitot tube extending radially of said axis in the casing and having adjacent its outer end an inlet facing in a direction opposite to the direction of rotation of the rotary casing, the pitot tube having a diffuser passage connected to the inlet and extending toward the axis to an outlet port connected to the discharge duct, and e. separating means cooperatively associated with the gas supply passage upstream of the outlet thereof for centrifugally separating liquid from gas in the supply passage, whereby gas delivered to the interior of the casing is essentially free of liquid.

2. A pitot compressor according to claim 1 wherein the separating means is mounted for rotation with the casing.

3. A pitot compressor according to claim 1 wherein the gas supply passage is disposed within the casing and includes a return bend portion in which gas proceeding toward the gas supply passage outlet flows first away from said axis and then toward the axis, the supply passage walls at least in the extremity of the return bend portion remote from the axis being defined by the casing, and a liquid extraction duct fixed in the supply passage and having an inlet facing opposite to the direction of casing rotation in the extremity of the supply passage return bend portion.

4. A pitot compressor according to claim 3 wherein the gas supply passage return bend portion is disposed circumferentially about the gas discharge duct.

5. A pitot compressor according to claim 1 wherein the casing defines a pumping chamber in which the pitot tube is disposed, the separating means being disposed in the casing upstream of the pumping chamber along the gas supply passage.

6. A pitot compressor according to claim 5 wherein the gas supply passage includes a separation chamber disposed circumferentially of the discharge duct, the walls of the separation chamber disposed outwardly of the axis being defined by the casing, and a stationary liquid extraction duct disposed in the separation chamber, the extraction duct having a liquid inlet opening positioned proximate the chamber wall in the outermost extent of the separation chamber radially from said axis and facing in a direction opposite to the direction of casing rotation.

7. A pitot compressor according to claim 5 wherein the casing defines a pumping chamber end wall disposed substantially normal to said axis, the gas supply passage outlet is defined through the end wall adjacent the outer extent of the chamber, the gas supply passage leading to the outlet thereof is disposed substantially in the end wall, and the liquid separating means is disposed in the end wall inwardly toward the axis from the supply passage outlet along the radial portion of the supply passage.

8. A pitot compressor according to claim 7 including liquid receiving means or receiving liquid separated from supply gas by the separating means, and a liquid extraction duct having an inlet end positioned in the liquid receiving means.

9. A pitot compressor according to claim 8 wherein the liquid receiving means comprises an annular recess defined by the casing along the pumping chamber end wall adjacent to the separating means separately from the gas supply passage, the recess opening toward the casing axis, and a liquid flow connection through the end wall from the gas supply passage radial portion to the recess for supplying to the recess liquid separated from supply gas by the separating means.

10. A pitot compressor according to claim 9 wherein the recess is defined by a projection from the chamber end wall circumferentially of the casing axis radially inwardly from the supply passage outlet, the projection extending away from the end wall substantially parallel to the axis and then towards the axis.

11. A pitot compressor according to claim 10 wherein the projection extends from the chamber end wall into the chamber.

12. A pitot compressor according to claim 11 wherein the pitot tube inlet is disposed radially outwardly in the chamber from the projection.

13. A pitot compressor according to claim 9 wherein the extraction duct is stationary and has its inlet end disposed in the recess and facing in a direction opposite to the direction of casing rotation.

14. A pitot compressor according to claim 9 wherein the separating means comprises a second recess defined by that wall of the gas supply passage radial portion which is the rear wall of the passage relative to the direction of casing rotation, the second recess facing upstream along the radial portion of the gas supply passage, the liquid flow connection connecting the second recess with the liquid receiving annular recss.

15. A pitot compressor according to claim 9 wherein the separating means comprises a second recess defined circumferentially about the radial portion of the gas supply passage and facing upstream along the supply passage, and vane means disposed in the gas supply passage upstream of the second recess within the chamber end wall, the vane means being arranged to impart a spiral flow pattern to gas flowing therepast toward the supply passage outlet whereby liquid present in gas flowing past the vane means is centrifugally separated from the gas by the spiral flow pattern and flows along the supply passage into the second recess, the liquid flow connection opening into the second recess.

16. A pitot compressor according to claim 9 wherein the separating means comprises a plurality of staggered baffles spaced along the radial portion of the gas supply passage, the baffles being arranged for impingement thereon of liquid present in gas moving therepast and for flow of impinged liquid centrally of the supply passage to a terminal baffle disposed centrally of the passage and defining a second recess facing upstream along the supply passage, the liquid flow connection opening into the second recess.

17. A pitot compressor according to claim 9 wherein the separating means comprises a cyclone separator in the portion of the gas supply passage defined in the pumping chamber end wall, the separator having a gas-liquid entrance and an adjacent gas exit disposed radially inwardly from a separated liquid sump of the separator, the liquid flow connection opening into the sump.

18. A pitot compressor comprising a. a rotary casing mounted for rotation in a selected direction about an axis, b. a gas supply passage for delivering a gas to be compressed through an outlet of the gas supply passage to the interior of the casing, the gas supply passage being defined at least in substantial part by the casing, c. a compressed gas discharge duct coaxial with the casing, d. a pitot tube extending radially of said axis in the casing and having adjacent its outer end an inlet facing in a direction opposite to the direction of rotation of the rotary casing, the pitot tube having a diffuser passage connected to the inlet and extending toward the axis to an outlet port connected to the discharge duct, e. liquid separating means carried by the casing in association with the gas supply passage upstream of the outlet thereof for centrifugally separating liquid from gas in the supply passage, whereby gas delivered to the interior of the casing is essentially free of liquid, and f. means for extracting from the compressor liquid separated from the supply gas by the liquid separating means.

* * * * *

UNITED STATES PATENT AND TRADEMARK OFFICE

CERTIFICATE OF CORRECTION

PATENT NO. : 4,059,364

DATED : November 22, 1977

INVENTOR(S) : Poul H. Andersen, John W. Erickson

It is certified that error appears in the above-identified patent and that said Letters Patent are hereby corrected as shown below:

Column 1, line 24, "and" should be -- an --;
line 31, "pilot" should be -- pitot --;
line 56, "3,816,446" should be -- 3,817,446 --.
Column 4, line 8, "divideds" should be -- divides --;
line 59, "inlert" should be -- inlet --.
Column 6, line 19, "19" should be -- 10 --.
Column 7, line 12, "chamer" should be -- chamber --;
line 42, "Receses" should be --Recesses--.
Column 8, line 13, "circumferentialy" should be -- circumferentially --;
line 66, "assocation" should be -- association --.
Column 10, line 20, "acssociated" should be -- associated --;
line 55, "ciruitous" should be -- circuitous --.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*